United States Patent [19]

Smith et al.

[11] Patent Number: 4,621,991

[45] Date of Patent: Nov. 11, 1986

[54] QUIET BY-PASS VACUUM MOTOR

[75] Inventors: Francis E. Smith, Chagrin Falls; Robert L. Hyatt, Tallmadge; Leonard J. Kline, Jr., Ravenna, all of Ohio

[73] Assignee: Ametek, Inc., Kent, Ohio

[21] Appl. No.: 704,321

[22] Filed: Feb. 22, 1985

[51] Int. Cl.[4] ..... F04B 17/00

[52] U.S. Cl. ..... 417/423 A; 417/368; 310/239

[58] Field of Search ..... 417/368, 371, 366, 423 A, 417/423 R; 310/239, 242, 249, 71, 90; 15/413

[56] References Cited

U.S. PATENT DOCUMENTS

| | | | |
|---|---|---|---|
| 3,826,935 | 7/1974 | Grierson et al. | 310/71 |
| 3,932,070 | 1/1976 | Porter et al. | 417/368 |
| 4,059,776 | 11/1977 | Schreiber et al. | 310/242 |
| 4,088,424 | 5/1978 | Hyatt et al. | 417/368 |
| 4,226,575 | 10/1980 | Hyatt et al. | 417/368 |
| 4,429,204 | 1/1984 | McGuire et al. | 310/90 |
| 4,431,933 | 2/1984 | Mabuchi | 310/242 |

FOREIGN PATENT DOCUMENTS

| | | | |
|---|---|---|---|
| 1653640 | 8/1971 | Fed. Rep. of Germany | 417/368 |
| 2833680 | 2/1980 | Fed. Rep. of Germany | 417/368 |
| 563530 | 6/1957 | Italy | 417/366 |

*Primary Examiner*—Carlton R. Croyle
*Assistant Examiner*—Donald E. Stout
*Attorney, Agent, or Firm*—Oldham, Oldham & Weber Co.

[57] ABSTRACT

A by-pass vacuum motor assembly wherein the motor cooling fan is positioned in an opening at the bottom of the motor band and immediately above a flat plate portion of the fan housing bracket. The flat plate portion functions as a plate diffuser, redirecting air drawn through the commutator end bracket and across the motor internals into a radial exhaust between a bottom portion of the band and a top portion of the fan end bracket. The invention also includes a brush holder clip passing through a vertical opening in the commutator end bracket and engaging a collar on the brush mechanism. The brush mechanism passes through a horizontal opening in the commutator end bracket which intersects with the vertical opening. Armature grounding is achieved by a disk maintained in a recess in the commutator end bracket and urged by a spring against the bearing receiving the motor shaft. The power wires to the motor are secured by a tab maintained opposite an opening in the commutator end bracket which is itself opposite an opening in the band. Power wires pass through the openings and over the tab, being crimped thereby.

19 Claims, 7 Drawing Figures

QUIET BY-PASS VACUUM MOTOR

TECHNICAL FIELD

The invention herein resides in the art of dynamo-electric machines. Specifically, the invention relates to by-pass vacuum motors as presently known in the art, in which the working air by-passes the motor and a separate cooling airstream is developed for cooling the motor and maintaining the integrity thereof.

BACKGROUND ART

Presently, many types of vacuum motors and by-pass vacuum motors are known. The best example of such a motor, for purposes of appreciating the instant invention, is set forth in U.S. Pat. No. 4,226,575, assigned to the assignee of the invention disclosed herein. In previously known motors of this type, and of motors in general, it is desirable to ground the armature. In previously known motors, such grounding has been a rather simple task, since the end bell or top end bracket receiving the rotating member has been of a metallic nature. Grounding of the top end bracket has achieved the desired armature grounding. However, the advent of high strength plastics, particularly when used for manufacture of the end bell, has eliminated such a grounding technique. Plastic motor housings have necessitated the use of expensive and complex grounding mechanisms.

The motor brushes of the vacuum motors of interest have typically been received in a brush holder which, of necessity, requires time consuming and often complex structures to fixedly secure the brush holder to the motor housing. This significantly increases both the cost and complexity of the motor. Prior to the invention disclosed herein, there has been no inexpensive and simplistic method for securing brushes to the motor housing while assuring that the brush holder is, indeed, secured.

It is known that power wires entering or leaving a motor housing must be secured to prevent inadvertent dislodgment. Typically, a clip, clamp, or the like has been used to secure the wires at the point of entry or exit of the motor housing. Such techniques have required undesirable manufacturing steps and increased the number of parts necessary for the manfacture of the motor, increasing both the cost and complexity of the unit. No method has previously been known by which securement of the power wires is automatically achieved upon assembly of the elements of the motor housing itself.

Further, operational noise levels of vacuum motors have become an increasingly bothersome matter. Each airstream or moving member contributes to the total noise generated by the operating system. In by-pass vacuum motors, where two or more airstreams each contribute noise components to the aggregate noise level, the noise levels may readily become undesirable. Each fan, particularly those in proximity to small orifices or abrupt surfaces tend to contribute significantly to this problem. Accordingly, it is most desirable to achieve a by-pass vacuum motor in which the noise components of the various airstreams are reduced. Particularly, it is desired to reduce the noise component of the motor cooling fan itself.

DISCLOSURE OF INVENTION

In light of the foregoing, a first aspect of the invention is to provide a quiet by-pass vacuum motor wherein an armature ground clip is easily, inexpensively and reliably interconnected with the rotating member.

Another aspect of the invention is the provision of a quiet by-pass vacuum motor incorporating a brush clip which is easily positioned while securedly maintaining the brush holder.

Still another aspect of the invention is the provision of a quiet by-pass vacuum motor wherein off-set openings in mating sections of the housing are adapted to receive and securedly maintain power wires upon joinder of housing parts.

Still an additional aspect of the invention is the provision of a quiet by-pass vacuum motor wherein the motor cooling fan is provided beneath the motor itself in a unique manner to significantly reduce air turbulence and resultant noise.

Yet a further aspect of the invention is the provision of a quiet by-pass vacuum motor which is simplistic in construction, reliable in operation, and easily implemented utilizing state of the art structures and techniques.

The foregoing and other aspects of the invention which will become apparent as the detailed description proceeds are achieved by a motor assembly, comprising: a commutator end bracket receiving a commutator; a fan end bracket receiving a working air fan assembly; a band interconnecting said brackets and maintaining field coils and an armature therein; a motor shaft receiving said commutator at a first end thereof and said working fan assembly at a second end thereof and passing centrally through said field coils and armature; and a motor cooling fan maintained upon said shaft within an opening within a bottom portion of said band.

DESCRIPTION OF THE DRAWINGS

For a complete understanding of the objects, techniques, and structure of the invention reference should be had of the following detailed description and accompanying drawings wherein.

DETAILED DESCRIPTION OF PREFERRED EMBODIMENT

Figure 1A:
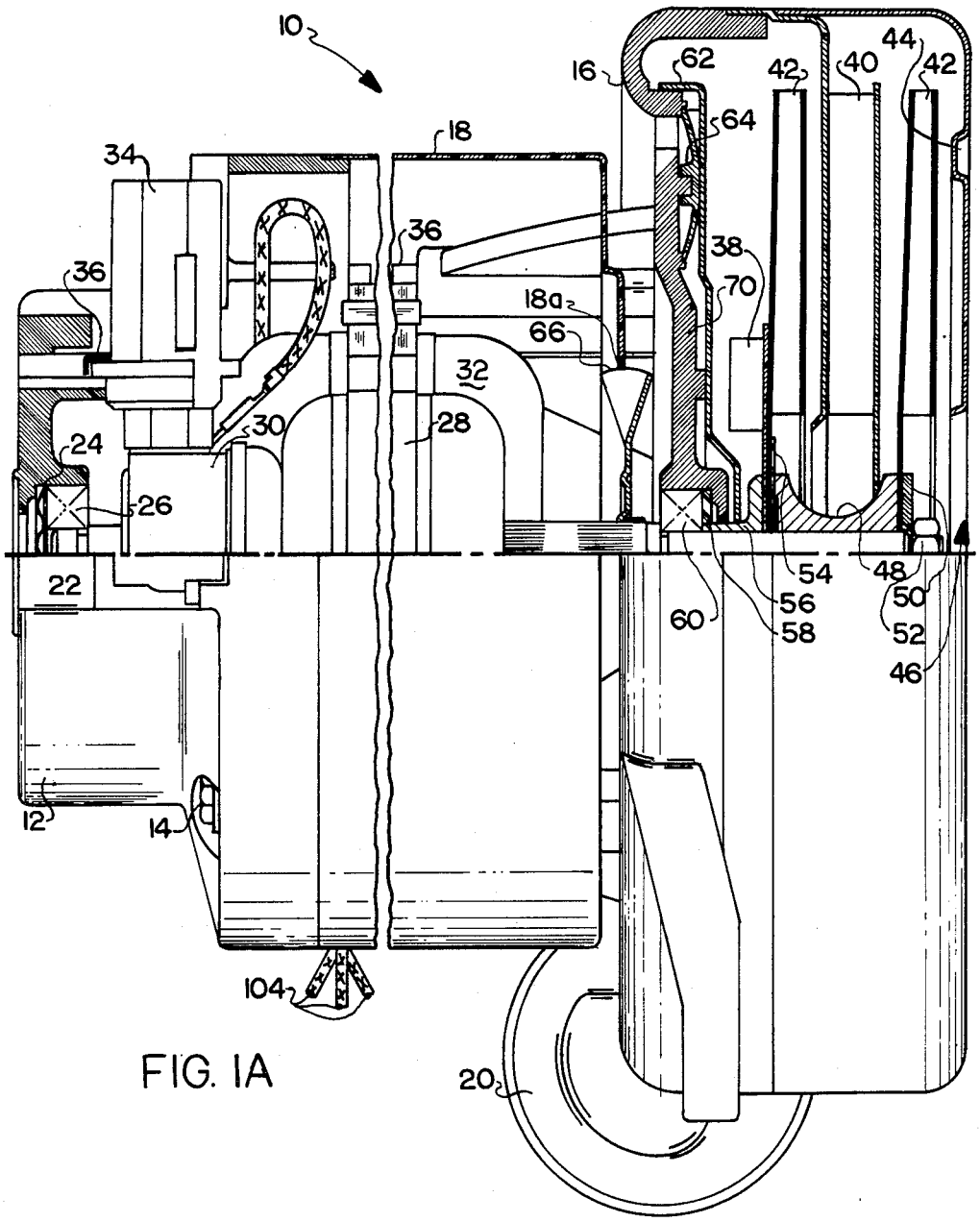
FIG. 1, consisting of FIGS. 1A and 1B, respectively present a partial sectional view of the vacuum motor of the invention and top plan view thereof.

Referring now to the drawings and more particularly FIG. 1, it can be seen that the quiet by-pass vacuum motor of the invention is designated generally by the numeral 10. A commutator end bracket 12, preferably of plastic construction, is connected by screws 14 to the fan end bracket 16, with the band 18 interposed and retained therebetween. The structure of elements 12–18 defines a housing maintaining both the motor and the vacuum fans driven thereby. A working air exhaust port or horn 20 is provided for discharging the working air drawn up through the bottom of the fan shell 44 in standard fashion.

A load spring 22 is received within a cavity in the central end of the commutator end bracket 12, urging against a ground lead terminal disk 24. The disk 24 is urged by the spring 22 against the bearing 26 which receives the motor shaft of the armature 28 and commutator 30. The specific structure just described will be presented in detail hereinafter. Suffice it to say, the disk 24 makes grounding engagement with the shaft through the armature bearing 26. Also received within the housing, and particularly enclosed by the band 18 are the field coils 32.

A pair of brush mechanisms 34 are received by the commutator end bracket 12 and fixedly retained in operative position by a brush clip 36, shown generally in FIG. 1, but shown in detail in FIG. 4, as will be discussed hereinafter.

A fan arrangement, consisting of the fan 38, stationary fan 40, and rotating fans 42 is maintained within the fan shell 44, closing the fan end bracket 16. Of course, the fan shell 44 is open at the end 46 to define a fan eye for generation of the desired pressure differential. In somewhat standard fashion, the various fan elements just described are secured in defined positional relationship with each other by means of a spacer 48, washer 50, nut 52, washer 54, spacer 56, and bearing 60. A washer 58 is maintained between the bearing 60 and the bracket 16. The ball bearing 60 receives the end of the motor shaft opposite that received by the bearing 26, upon which shaft are mounted the fan elements just described. Further, and as is known from the prior art, an air seal shell 62 is provided as is a check valve 64 to prevent backflow of the working air to the bearing 60. The fan structure just described is substantially similar to that present in the aforementioned U.S. Pat. No. 4,226,575.

Figure 1B:
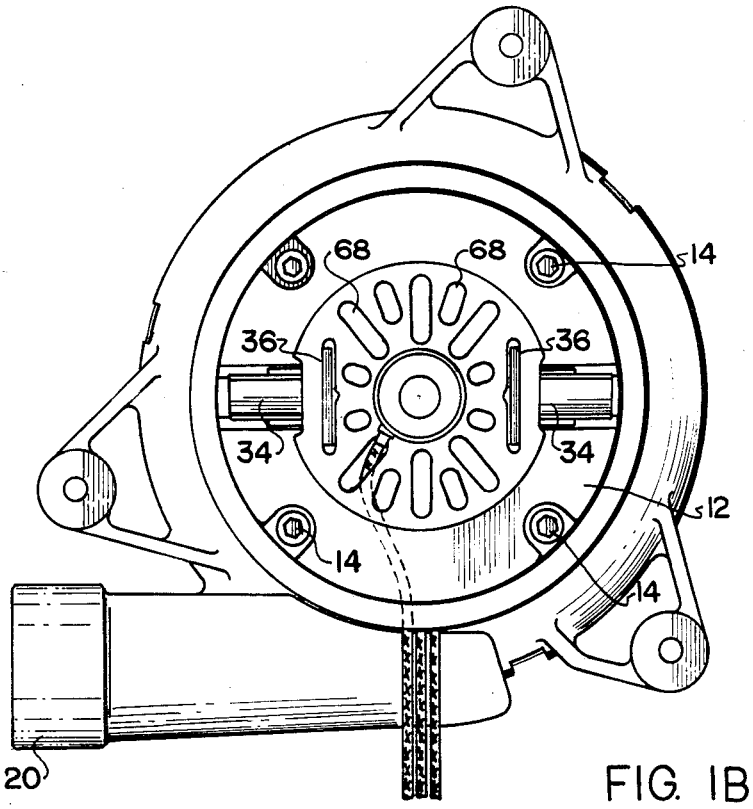

With continued reference to FIGS. 1A and 1B, it can be seen that a motor cooling fan 66 is provided upon the motor shaft beneath the motor, interposed between the motor and the vacuum fan assembly. In contradistinction, the prior art of U.S. Pat. No. 4,226,575 taught the positioning of a motor cooling fan above the motor, within the commutator end bracket and immediately opposite a plurality of openings within the end bracket through which motor cooling air was to be drawn. According to the instant invention, a plurality of openings 68 are provided in the commutator end bracket 12 with air being drawn therethrough by the motor cooling fan 66. As can be seen, the fan 66 is maintained far from the openings 68 in the end bracket 12 such that the fan blades do not pass in close proximity to the orifices through which the air is to pass. This greatly reduces any siren effect or noise generated by the turbulence of the fan passing across the orifices or abrupt changes in surface contour.

In operation, cooling air enters the grid of openings 68 in the top of the commutator end bracket 12, passes over the field coils 32, and between the armature 28 and field coils 32 within the confines defined by the band 18. The armature windage assists the effectiveness of the motor cooling air in covering all motor internals in somewhat standard fashion. The cooling air is then drawn by the fan 66 through the fan and onto the top plate portion 70 of the fan end bracket 16. The plate portion 70 acts as a plate diffusion system, deflecting the spiraling air having both radial and axial vector components. The air is dispersed in the area between the bottom of the band 18 and the top of the fan end bracket 16. In contradistinction to the prior art, the motor cooling air is dispelled through the proximity ring area 18*a* of the band 18 and redirected onto the flat plate-like surface 70 rather than through a plurality of small apertures maintained within the band 18. The internal positioning of the fan 66 in relation to the band 18 and the fan bracket 16 reduces the potentiality of noise generated by air turbulence.

The air passing through the fan 66 onto the plate 70 has both radial and axial components. The radial component seeks to direct the airflow along the bottom of the band 18 in the space between the band 18 and flat plate portion 70. The axial component is redirected by the plate 70 radially outward in such space, joining the radial component for nonturbulent exhausting of the air. The fan 66 is positioned with respect to the plate portion 70 such that turbulence is minimized. Such positioning is a function of the parameters of fan size, pitch and rotational speed. In general, approximately equal volume passages are defined by the fan 66 and by the space between the bottom of the band 18 and the flat plate portion 70. For this reason, the contour of the plate portion 70 tracks the contour of the bottom of the band 18 as shown. To optimize fan efficiency, the blade tips of the fan 66 are maintained immediately adjacent the edge of the proximity ring 18*a*.

Figure 2:
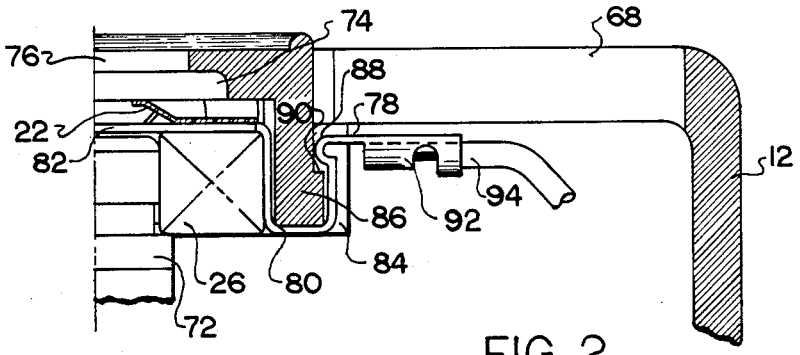
FIG. 2 is a partial sectional view of the armature ground clip of the invention.

With reference now to FIG. 2, an appreciation of the armature grounding of the invention may be obtained. The motor or armature shaft 72 is received by the bearing 26 at a central end portion of the commutator end bracket 12 as shown. This portion of the end bracket 12 is characterized by a stepped recess 74, with one of the steps receiving the load spring 22. An opening 76 is centrally positioned in the end bracket 12 and with respect to the recess 74. A clip 78, having a U-shaped portion 80 extends to a disk portion 82 which is forcefully maintained between the load spring 22 and the bearing 26. The disk portion 82 corresponds to the disk 24 generally presented above with respect to FIG. 1. With the clip 78 constructed of an electrically conductive material, current conducting contact is thus made through the bearing 26 to the shaft 72.

A pair of flanges 84 are molded as a portion of the end cap 12 and extend on either side of a tower 86 similarly formed. The U-shaped portion 80 is forced over the tower 86 and between the flanges 84 such that the disk portion 82 is maintained in the recess 74 between the spring 22 and bearing 26. A knuckle 88 on the clip 78 snaps over a lip 90 on the tower 86 to achieve secured engagement. A connector 92 is crimped onto the ground wire 94 to complete the grounding circuit. Accordingly, even with the cap 12 being constructed of a non-conductive material, grounding of the armature shaft 72 may be readily achieved by the position of the spring biased ground clip as just described.

With further consideration to FIG. 2, it will be appreciated that the grounding assembly could take the form of another embodiment, in which the tower 86 is eliminated, as is the U-shaped portion 80 of the clip. In such a case, the clip is simply forced between the two flanges 84 and held there by a friction fit. In such an instance, the clip simply comprises a linear strip of conductive material leading to the disk 82. Of course, the wire 94 may itself be forced between the two flanges 84, with such flanges gripping the wire insulation.

Figure 3B:
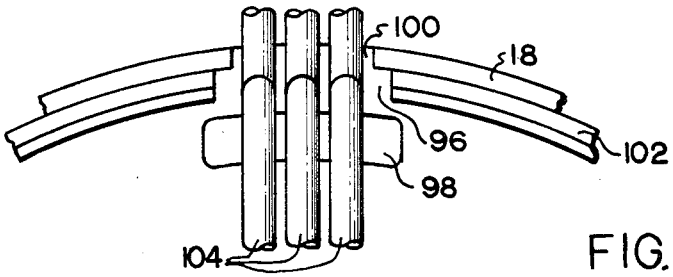
FIG. 3, consisting of FIGS. 3A and 3B, respectively present side sectional and top perspective views of the wire retention technique and structure of the invention.
Figure 3A:
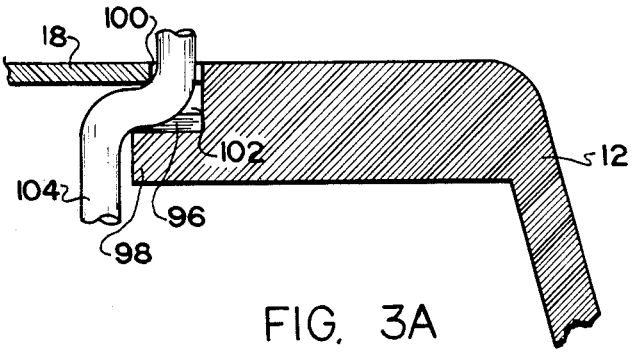

With attention now given to FIG. 3, it will be seen that the power wires of the motor 10 are securely retained by a unique interengagement between the band 18 and the commutator end bracket 12. As shown, an opening 96 is provided in a peripheral edge of the end bracket 12 with an offset tab 98 maintained therebehind. A corresponding opening 100 is provided in the band 18. When the band 18 mates about the circumferential lip 102 of the end cap 12, the offset tab 98 extends beyond the opening 100 of the band 18 to crimp the wires 104, as shown. In other words, the wires 104 pass over the tab 98, downwardly through the opening 96, and out the opening 100 to exit the motor housing. The openings 96,100, in combination with the tab 98, thus define an opening having a vertical and horizontal component to achieve the crimping action.

The structure just described with respect to FIG. 3 achieves a reliable securing engagement of the power wires, preventing them from being dislodged. The technique is simplistic in that the wires 104 need merely be positioned in registration with the openings 96,100 when the band 18 is engaged with the cap 12. Interconnection of the cap 12, band 18, and bracket 16 automatically achieves the locking or crimping operation, eliminating the need of extra parts or steps in assembly.

Figure 4A:
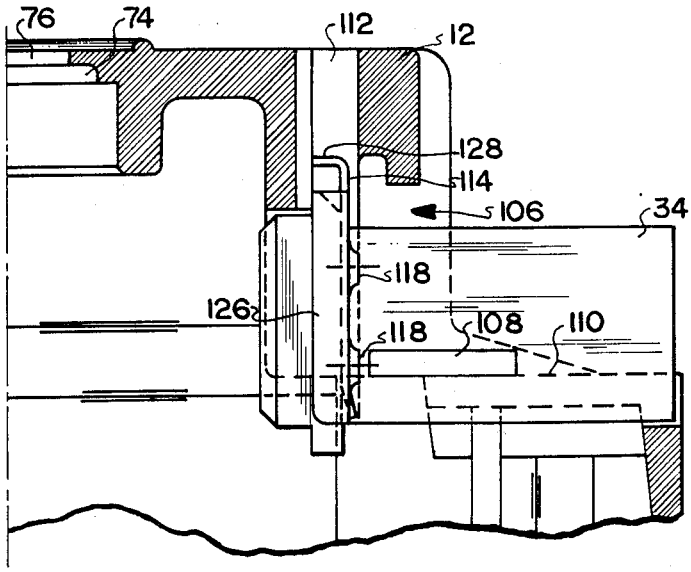
FIG. 4, consisting of FIGS. 4A and 4B, respectively present side sectional and bottom perspective views of the brush retention mechanism of the invention.
Figure 4B:
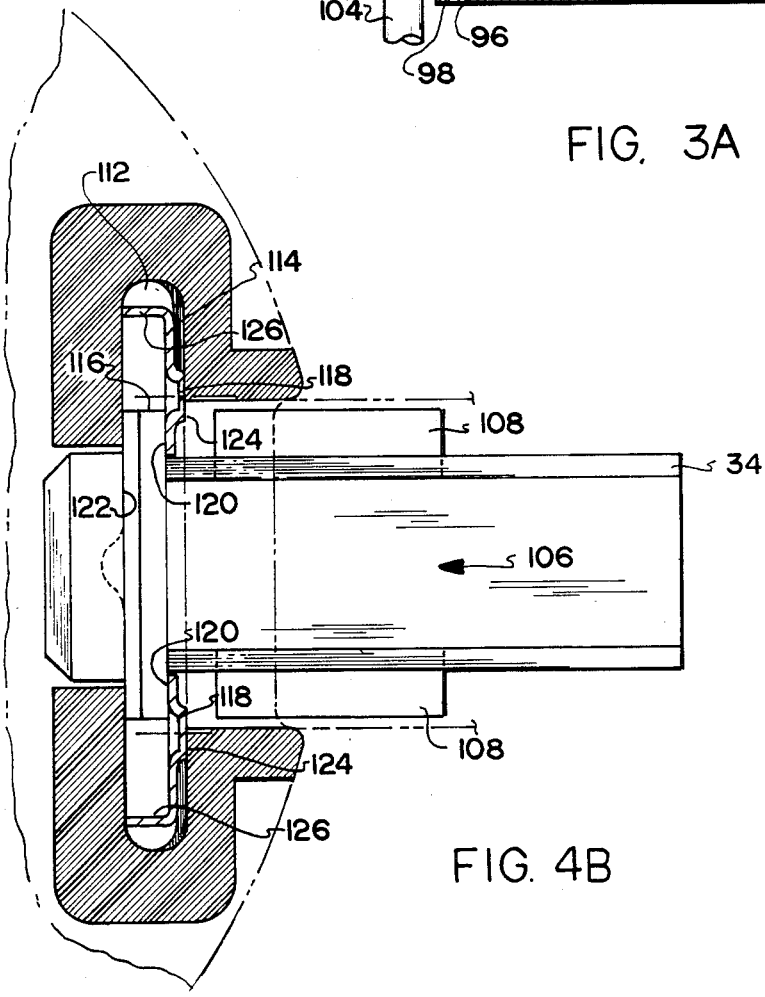

To quickly and reliably secure the brush holders of the motor assembly 10, the unique structure of FIG. 4 has been devised. As illustrated, the commutator end bracket 12 is provided with an opening 106 adapted for receiving the brush holder 34 therein, allowing the brush to communicate with the interior of the motor assembly. A support flange 108 on the brush mechanism 34 is received upon a track 110 molded as part and parcel of the cap 12. A vertical opening 112 intersects the opening 106 as shown. The vertical opening 112 is characterized by a negative draft, being wider at the bottom than at the top, for purposes to be discussed below.

A clip 114 is shown in detail in FIG. 4, while having been generally denoted by the numeral 36 in FIG. 1. The clip 114 is adapted to be received over a picture frame collar 116 which extends about the body of the brush mechanism 34. The clip 114 has four protrusions or nipples 118 extending from a back surface thereof. The clip 114 engages the collar 116 as at 120, forcing the collar 116 against the front wall of the opening 112 as at 122. The nipples 118 engage the back wall of the opening 112 as at 124. The side flanges 126, extending from the clip 114, make contacting engagement with the front wall of the opening 112 as does the top flange 128.

With the brush mechanism 34 inserted through the opening 106, and the collar 116 positioned within the opening 112, the clip 114 is inserted into the opening 112 and over the collar to achieve secured engagement. The negative draft of the opening 112, with the back walls being in forceful engagement with the nipples 118, forces the top flange 128 forward into the front wall thereof. The clip 114 is thus distorted and acts as a biasing spring, urging the collar 116 forward against the front wall. The brush mechanism 34 is easily inserted and easily secured by means of the clip 114, particularly since no threaded members or the like are involved. By inserting two members into intersecting openings, the forceful secured engagement is achieved. Because of the distortion of the clip 114, acting as a spring against the collar 116, dislodgment of the brush mechanism 34 is most unlikely.

Thus it can be seen that the objects of the invention have been achieved by the apparatus presented hereinabove. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be had to the following claims.

What is claimed is:

1. In a vacuum motor assembly comprising a commutator end bracket housing a commutator, a fan end bracket housing a working air fan assembly, a band interconnecting the brackets and maintaining field coils and an armature therein, the commutator being received on a first end of a motor shaft and the working air fan assembly received on a second end thereof, the shaft passing through the coils and armature, the improvement, comprising:

a motor cooling fan maintained upon the shaft and between the working air fan assembly and the field coils and armature, said motor cooling fan being received and rotational within an opening in a bottom portion of the band, said bottom portion of tbe band being maintained in spaced relation to a top portion of the fan end bracket, said top portion of the fan end bracket comprising a substantially flat plate in the area below said motor cooling fan, said flat plate receiving air passing axially through said motor cooling fan and radially redirecting said air between said bottom portion of the band and said top portion of the fan end bracket, and wherein said bottom portion of the band tracks said top portion of the fan end bracket, defining a passage of substantially uniform dimensions.

2. The improvement as recited in claim 1 wherein the shaft is received within a recess in the commutator end bracket, and further including grounding means secured to the commutator end bracket and in electrical contact with the shaft for electrically grounding the shaft.

3. The improvement as recited in claim 2 wherein said grounding means comprises an electrically conductive disk received within said recess.

4. The improvement as recited in claim 3 wherein said shaft is received within a bearing and which further includes a spring received within said recess and urging said disk against said bearing.

5. The improvement as recited in claim 3 wherein the commutator end bracket includes a pair of flanges in juxtaposition to said recess, said flanges receiving said grounding means in securing engagement.

6. The improvement as recited in claim 1 which further includes a brush mechanism received by the commutator end bracket, said brush mechanism passing through a horizontal opening in the commutator end bracket, said horizontal opening being intersected by a vertical opening in the commutator end bracket.

7. The improvement as recited in claim 6 wherein said vertical opening has a negative draft, being wider at the bottom thereof than the top.

8. The improvement as recited in claim 7 wherein said brush mechanism has a collar thereabout, said collar positioned within the intersection of said horizontal and vertical openings.

9. The improvement as recited in claim 8 which further includes a clip received within said vertical opening, over said collar, and engaging said collar in forceful engagement against a forward wall of said vertical opening.

10. The improvement as recited in claim 1 wherein the commutator end bracket is characterized by an opening in a peripheral edge thereof and an off-set tab positioned within the housing defined by the commutator end bracket opposite said opening.

11. The improvement as recited in claim 10 wherein the band has an opening in a peripheral edge thereof opposite said opening in said peripheral edge of said commutator end bracket.

12. The improvement as recited in claim 11 further including wires passing through said openings and over said off-set tab and being crimped thereover upon interconnection of the commutator end bracket with the band.

13. A motor assembly, comprising:

a commutator end bracket receiving a commutator;

a fan end bracket receiving a working air fan assembly;

a band interconnecting said brackets and maintaining field coils and an armature therein;

a motor shaft receiving said commutator at a first end thereof and said working fan assembly at a second end thereof and passing centrally through said field coils and armature;

a motor cooling fan maintained upon said shaft within an opening within a bottom portion of said band and drawing air over said field coils and armature, wherein said bottom portion of said band is maintained in substantially constant spaced relationship from a top portion of said fan end bracket; and wherein said commutator end bracket is characterized by intersecting horizontal and vertical openings, said horizontal opening receiving therein a brush mechanism, said brush mechanism including a collar thereabout, said collar positioned within an area of intersection between said horizontal and vertical openings, said vertical opening having a negative draft and receiving a clip engaging said collar.

14. The motor assembly according to claim 13 wherein said top portion of said fan end bracket comprises a substantially flat plate in an area opposite said motor cooling fan, receiving air passing through said motor cooling fan and redirecting said air through said space between said top portion of said fan end bracket and said bottom portion of said band.

15. The motor assembly accoding to claim 13 wherein said shaft is received within a bearing maintained within a recess in an end of said commutator end bracket, said recess receiving an electrically conductive disk in communication with said bearing.

16. The motor assembly according to claim 15 wherein a spring is maintained within said recess, urging said disk into engagement with said bearing.

17. The motor assembly according to claim 16 wherein a conductor extends from said disk, said conductor received and maintained between flanges extending from said commutator end bracket.

18. The motor assembly according to claim 13 wherein said commutator end bracket has an opening in a periphery thereof, and a tab positioned behind said opening.

19. The motor assembly according to claim 18 wherein said band has an opening in a peripheral edge thereof, said openings being in juxtaposition to each other and receiving wires therethrough and over said tab.

* * * * *